US007425258B2

(12) United States Patent
Chen et al.

(10) Patent No.: US 7,425,258 B2
(45) Date of Patent: Sep. 16, 2008

(54) $C_6$ RECYCLE FOR PROPYLENE GENERATION IN A FLUID CATALYTIC CRACKING UNIT

(75) Inventors: Tan Jen Chen, Kingwood, TX (US); Brian Erik Henry, Baton Rouge, LA (US); Paul F Keusenkothen, Houston, TX (US); Philip A. Ruziska, Kingwood, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 471 days.

(21) Appl. No.: 10/760,800

(22) Filed: Jan. 20, 2004

(65) Prior Publication Data

US 2004/0182747 A1 Sep. 23, 2004

Related U.S. Application Data

(60) Provisional application No. 60/450,850, filed on Feb. 28, 2003.

(51) Int. Cl.
*C10G 11/00* (2006.01)
*C07C 4/02* (2006.01)

(52) U.S. Cl. ..... 208/113; 208/120.01; 585/653

(58) Field of Classification Search ..... 208/113, 208/120.01; 585/653
See application file for complete search history.

(56) References Cited

U.S. PATENT DOCUMENTS 2,426,903 A * 9/1947 Sweeney ..... 208/67
3,692,667 A * 9/1972 McKinney et al. ..... 208/120.01
4,051,013 A 9/1977 Strother ..... 208/78
4,717,466 A * 1/1988 Herbst et al. ..... 208/113
5,082,983 A 1/1992 Breckenridge et al. ..... 585/475
5,087,349 A 2/1992 Goelzer et al. ..... 208/113
5,264,115 A 11/1993 Mauleon et al. ..... 208/67
5,358,918 A 10/1994 Yukang et al. ..... 502/67
5,389,232 A * 2/1995 Adewuyi et al. ..... 208/120.01
5,486,284 A * 1/1996 Degnan et al. ..... 208/120.15
5,506,365 A 4/1996 Mauleon et al. ..... 585/329
5,846,403 A 12/1998 Swan et al. ..... 208/113

(Continued)

FOREIGN PATENT DOCUMENTS

BE 1061116 12/2000

(Continued)

OTHER PUBLICATIONS

*Canadian Journal of Chem. Eng.*, 63(3), 451-461, 1985, (Reference 6, Queen's University, Kingston, Canada) entitled "Catalytic Cracking and Skeletal Isomerization of n-Hexene on SZM-5 Zeolite."

(Continued)

*Primary Examiner*—Glenn Caldarola
*Assistant Examiner*—John C Douglas
(74) *Attorney, Agent, or Firm*—Jeremy J. Kliebert; Bruce M. Bordelon

(57) ABSTRACT

The present invention relates to a process for selectively producing $C_3$ olefins from a catalytically cracked or thermally cracked naphtha stream. The process is practiced by recycling a $C_6$ rich fraction of the catalytic naphtha product to the riser upstream the feed injection point, to a parallel riser, to the spent catalyst stripper, and/or to the reactor dilute phase immediately above the stripper.

27 Claims, 2 Drawing Sheets

U.S. PATENT DOCUMENTS

| | | | | |
|---|---|---|---|---|
| 5,888,378 | A | 3/1999 | Kowalski | 208/114 |
| 6,069,287 | A | 5/2000 | Ladwig et al. | 585/648 |
| 6,080,303 | A | 6/2000 | Cao et al. | 208/120.01 |
| 6,090,271 | A | 7/2000 | Carpency et al. | 208/113 |
| 6,093,867 | A | 7/2000 | Ladwig et al. | 585/648 |
| 6,106,697 | A | 8/2000 | Swan et al. | 208/77 |
| 6,118,035 | A | 9/2000 | Fung et al. | 585/653 |
| 6,222,087 | B1 | 4/2001 | Johnson et al. | 585/651 |
| 6,258,257 | B1 | 7/2001 | Swan, III et al. | 208/74 |
| 6,258,990 | B1 | 7/2001 | Fung et al. | 585/330 |
| 6,313,366 | B1 | 11/2001 | Ladwig et al. | 585/648 |
| 6,315,890 | B1 | 11/2001 | Ladwig et al. | 208/67 |
| 6,339,180 | B1 | 1/2002 | Ladwig et al. | 585/330 |
| 6,339,181 | B1 | 1/2002 | Chen et al. | 585/653 |
| 2001/0025806 | A1 | 10/2001 | Steffens et al. | 208/113 |
| 2001/0042700 | A1 | 11/2001 | Swan, III et al. | 208/68 |
| 2001/0053868 | A1 | 12/2001 | Chester et al. | 585/648 |

FOREIGN PATENT DOCUMENTS

| | | |
|---|---|---|
| DE | 0152356 | 11/1981 |
| DE | 3609653 | 11/1986 |
| EP | 0654523 | 8/1999 |
| EP | 1205530 | 5/2002 |
| EP | 0849347 | 4/2003 |
| FR | EP0323297 | 6/1991 |
| JP | 61289049 | 12/1986 |
| WO | WO 00/40672 | 7/2000 |
| WO | WO 01/34727 | 5/2001 |
| WO | WO 01/34729 | 5/2001 |
| WO | WO 01/34730 | 5/2001 |
| WO | WO 01/64763 | 9/2001 |
| WO | WO 01/79383 | 10/2001 |
| WO | WO 01/90278 | 11/2001 |

OTHER PUBLICATIONS

*Chinese Journal of Catalysis* (Cuihua Zuebao), 11(2), 132-137, 1991, (Reference 4, Dalian Inst. of Chem. Phys., Academy Sinica, China) entitled "Studies on the Cracking of 1-Hexene over Pillared Clay Molecular Sieve."

Niccum, P.K., et al.; "Maxofintm: A Novel FCC Process for Maximizing Light Olefins Using a New Generation ZSM-5 Additive." Annual Meeting Mobil Technology Company National Petroleum Refines Association, Niccum, XX, XX, Mar. 1998, pp. 1-1A, XP002927512 the whole document.

* cited by examiner

$C_6$ RECYCLE FOR PROPYLENE GENERATION IN A FLUID CATALYTIC CRACKING UNIT

CROSS-REFERENCE TO RELATED APPLICATION

This application claims benefit of U.S. provisional patent application Ser. No. 60/450,850 filed Feb. 28, 2003.

FIELD OF THE INVENTION

The present invention relates to a process for selectively producing $C_3$ olefins from a catalytically cracked or thermally cracked naphtha stream in a fluid catalytic cracking process unit. The process is practiced by recycling a $C_6$ rich fraction of the catalytic naphtha product to the riser upstream of the feed injection point, to the riser downstream of the feed injection point, to a parallel riser, to the spent catalyst stripper, and/or to the reactor dilute phase immediately above the stripper.

BACKGROUND OF THE INVENTION

The need for low emissions fuels has created an increased demand for light olefins for use in alkylation, oligomerization, MTBE and ETBE synthesis processes. In addition, a low cost supply of light olefins, particularly propylene, continues to be in demand to serve as feedstock for polyolefin, particularly polypropylene production.

Fixed bed processes for light paraffin dehydrogenation have recently attracted renewed interest for increasing olefin production. However, these types of processes typically require relatively large capital investments as well as high operating costs. It is therefore advantageous to increase olefin yield using processes, which require relatively small capital investment. It is particularly advantageous to increase olefin yield in catalytic cracking processes.

U.S. Pat. No. 4,830,728 discloses a fluid catalytic cracking (FCC) unit that is operated to maximize olefin production. The FCC unit has two separate risers into which a different feed stream is introduced. The operation of the risers is designed so that a suitable catalyst will act to convert a heavy gas oil in one riser and another suitable catalyst will act to crack a lighter naphtha feed in the other riser. Conditions within the heavy gas oil riser can be modified to maximize either gasoline or olefin production. The primary means of maximizing production of the desired product is by using a catalyst that favors production of the desired product slate.

U.S. Pat. No. 5,389,232 to Adewuyi et al. describes a FCC process in which the catalyst contains up to 90 wt. % conventional large pore cracking catalyst and an additive containing more than 3.0 wt. % ZSM-5 (a medium pore catalyst) on a pure crystal basis on an amorphous support. The patent indicates that although ZSM-5 increases $C_3$ and $C_4$ olefins, high temperatures degrade the effectiveness of the ZSM-5. Therefore, a temperature of 950° F. to 1100° F. (510° C. to 593° C.) in the base of the riser is quenched with light cycle oil downstream of the base to lower the temperature in the riser 10° F.-100° F. (5.6° C.-55.6° C.). The ZSM-5 and the quench increase the production of $C_3/C_4$ light olefins but there is no appreciable ethylene product.

U.S. Pat. No. 5,456,821 to Absil et al. describes catalytic cracking over a catalyst composition which includes large pore molecular sieves, e.g., USY, REY or REUSY, and an additive of ZSM-5, in an inorganic oxide binder, e.g., colloidal silica with optional peptized alumina, and clay. The clay, a source of phosphorus, zeolite and inorganic oxide are slurried together and spray-dried. The catalyst can also contain metal such as platinum as an oxidation promoter. The patent teaches that an active matrix material enhances the conversion. The cracking products included gasoline, and $C_3$ and $C_4$ olefins but no appreciable ethylene.

European Patent Specifications 490,435-B and 372,632-B and European Patent Application 385,538-A describe processes for converting hydrocarbonaceous feedstocks to olefins and gasoline using fixed or moving beds. The catalysts included ZSM-5 in a matrix, which included a large proportion of alumina.

U.S. Pat. No. 5,069,776 teaches a process for the conversion of a hydrocarbonaceous feedstock by contacting the feedstock with a moving bed of a zeolite catalyst comprising a zeolite with a medium pore diameter of 0.3 to 0.7 nm, at a temperature above about 500° C. and at a residence time less than about 10 seconds. Olefins are produced with relatively little saturated gaseous hydrocarbons being formed. Also, U.S. Pat. No. 3,928,172 to Mobil teaches a process for converting hydrocarbonaceous feedstocks wherein olefins are produced by reacting said feedstock in the presence of a ZSM-5 catalyst.

A problem inherent in producing olefin products using FCC units is that the process depends on a specific catalyst balance to maximize production of light olefins while also achieving high conversion of the 650° F.$^+$ feed components to fuel products. In addition, even if a specific catalyst balance can be maintained to maximize overall olefin production relative to fuels, olefin selectivity is generally low due to undesirable side reactions, such as extensive cracking, isomerization, aromatization and hydrogen transfer reactions. Light saturated gases produced from undesirable side reactions result in increased costs to recover the desirable light olefins. Therefore, it is desirable to maximize olefin production in a process that allows a high degree of control over the selectivity of $C_3$ and $C_4$ olefins while producing minimal by-products.

SUMMARY OF THE INVENTION

An embodiment of the present invention provides a process for increasing the yield of propylene from heavy hydrocarbonaceous feeds in a fluidized catalytic process unit comprising at least a reaction zone, a stripping zone, a regeneration zone, and a fractionation zone, which process comprises:

(a) contacting, in said reaction zone under fluidized catalytic cracking conditions, a heavy hydrocarbonaceous feed with a catalytic cracking catalyst comprising a mixture of at least one large-pore molecular sieve and at least one medium-pore molecular sieve, wherein the average pore diameter of said large-pore molecular sieve is greater than about 0.7 nm, and the average pore diameter of said medium pore molecular sieve is less than about 0.7 nm, thereby resulting in spent catalyst particles containing carbon deposited thereon and a lower boiling product stream;

(b) contacting at least a portion of said spent catalyst particles with a stripping gas in the stripping zone under conditions effective at removing at least a portion of any volatiles therefrom thereby resulting in at least stripped spent catalyst particles;

(c) regenerating at least a portion of said stripped spent catalysts in a regeneration zone in the presence of an oxygen-containing gas under conditions effective at burning off at least a portion of said carbon deposited thereon thereby producing at least regenerated catalyst particles;

(d) recycling at least a portion of said regenerated catalyst particles to said reaction zone;

(e) fractionating said product stream of step (a) to produce at least a fraction rich in propylene, a $C_6$ rich fraction and a naphtha boiling range fraction;

(f) collecting at least a portion of the fraction rich in propylene and naphtha fraction; and (g) recycling at least a portion of said $C_6$ rich fraction to a place in the fluidized catalytic process unit selected from: i) upstream of the injection of the heavy hydrocarbonaceous feed; ii) the stripping zone; iii) a dilute phase above the stripping zone; iv) within the heavy hydrocarbonaceous feed; v) a reaction zone, separate from that wherein the hydrocarbonaceous feed is reacted; and vi) downstream of the injection of the heavy hydrocarbonaceous feed.

Another embodiment of the present invention provides a process for increasing the yield of propylene from heavy hydrocarbonaceous feeds in a fluidized catalytic process unit comprising at least a reaction zone, a stripping zone, a regeneration zone, and a fractionation zone, which process comprises:

(a) contacting, in said reaction zone under fluidized catalytic cracking conditions, a heavy hydrocarbonaceous feed with a catalytic cracking catalyst comprising a large-pore molecular sieve, wherein the average pore diameter of said large-pore molecular sieve is greater than about 0.7 nm, thereby resulting in spent catalyst particles containing carbon deposited thereon and a lower boiling product stream;

(b) contacting at least a portion of said spent catalyst particles with a stripping gas in the stripping zone under conditions effective at removing at least a portion of any volatiles therefrom thereby resulting in at least stripped spent catalyst particles;

(c) regenerating at least a portion of said stripped spent catalysts in a regeneration zone in the presence of an oxygen-containing gas under conditions effective at burning off at least a portion of said carbon deposited thereon thereby producing at least regenerated catalyst particles;

(d) recycling at least a portion of said regenerated catalyst particles to said reaction zone;

(e) fractionating said product stream of step (a) to produce at least a fraction rich in propylene, a $C_6$ rich fraction and a naphtha fraction;

(f) collecting at least a portion of the fraction rich in propylene and naphtha fraction; and (g) recycling at least a portion of said $C_6$ rich fraction to a place in the fluidized catalytic process unit selected from: i) upstream of the injection of the heavy hydrocarbonaceous feed; ii) the stripping zone; iii) a dilute phase reaction zone above the stripping zone; iv) co-currently with the injection of the heavy hydrocarbonaceous feed; v) a separate reaction zone; and vi) downstream of the injection of the heavy hydrocarbonaceous feed.

DETAILED DESCRIPTION OF THE INVENTION

Figure 1:
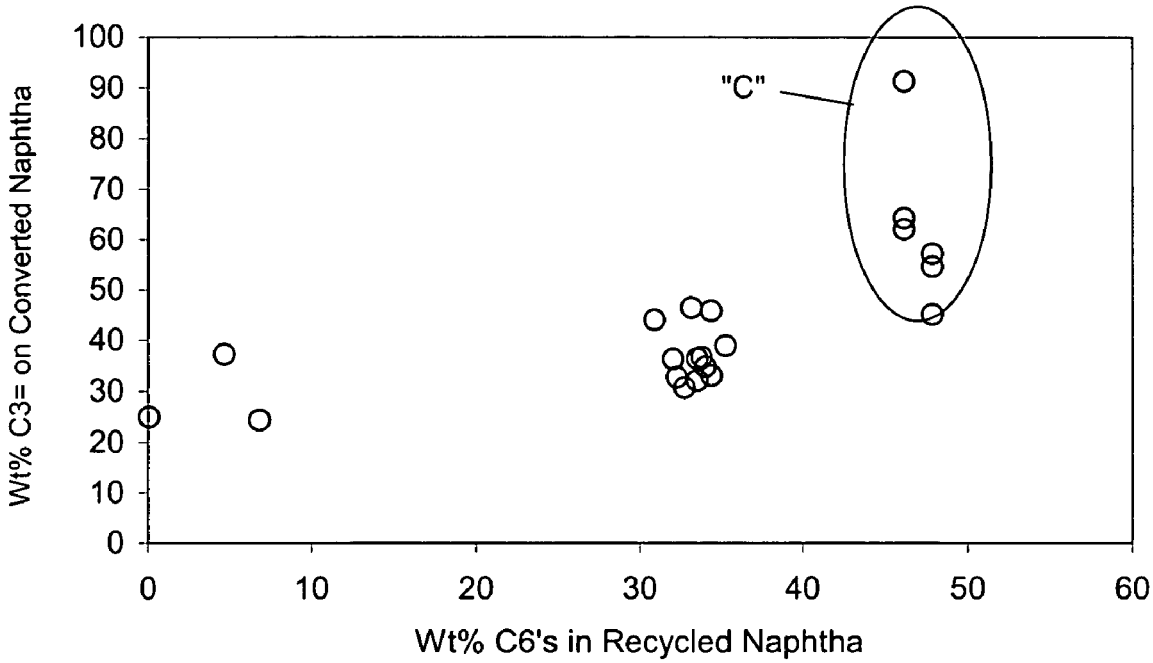
FIG. 1 shows propylene selectivity data.

The present invention relates to a process for selectively producing $C_3$ olefins in a fluidized catalytic cracking process unit (FCC). The process is practiced by recycling a $C_6$ rich fraction obtained from fractionating the product resulting from the cracking of the heavy hydrocarbonaceous feed. The $C_6$ rich fraction is recycled to the FCC unit at a point selected from the riser upstream from the feed injection point, the riser downstream the feed injection point, to a parallel riser or reaction zone, the stripping zone, a dilute phase reaction zone above the stripping zone, and within the feed being injected with the reaction zone. The $C_6$-rich fraction of the present invention is typically that fraction containing at least about 50 wt. %, preferably at least about 60 wt. %, and more preferably at least about 70 wt. % of $C_6$ compounds. It should be noted that the terms "upstream" and "downstream", as used herein, are taken in reference to the flow of the heavy hydrocarbonaceous feed.

Any conventional FCC feed can be used in the present invention. Such feeds typically include heavy hydrocarbonaceous feeds boiling in the range of about 430° F. to about 1050° F. (220-565° C.), such as gas oils, heavy hydrocarbon oils comprising materials boiling above 1050° F. (565° C.); heavy and reduced petroleum crude oil; petroleum atmospheric distillation bottoms; petroleum vacuum distillation bottoms; pitch, asphalt, bitumen, other heavy hydrocarbon residues; tar sand oils; shale oil; liquid products derived from coal liquefaction processes; and mixtures thereof. The FCC feed may also comprise recycled hydrocarbons, such as light or heavy cycle oils. Preferred feeds for use in the present process are vacuum gas oils boiling in the range above about 650° F. (343° C.).

In practicing the present invention, a heavy hydrocarbonaceous feed as defined above is conducted to a FCC process unit that typically includes a stripping zone, a regeneration zone, and a fractionation zone. The heavy hydrocarbonaceous feed is injected through one or more feed nozzles into at least one reaction zone, which is typically in a riser. Within this reaction zone, the heavy hydrocarbonaceuse feed is contacted with a catalytic cracking catalyst under cracking conditions thereby resulting in spent catalyst particles containing carbon deposited thereon and a lower boiling product stream. The cracking conditions are conventional and will typically include: temperatures from about 500° C. to about 650° C., preferably about 525 to about 600° C.; hydrocarbon partial pressures from about 10 to 50 psia (70-345 kPa), preferably from about 20 to 40 psia (140-275 kPa); and a catalyst to feed (wt/wt) ratio from about 1 to 12, preferably about 3 to 10, where the catalyst weight is total weight of the catalyst composite. Steam may be concurrently introduced with the feed into the reaction zone. The steam may comprise up to about 10 wt. % of the feed. Preferably, the FCC feed residence time in the reaction zone is less than about 10 seconds, more preferably from about 1 to 10 seconds.

Catalysts suitable for use herein are cracking catalysts comprising either a large-pore molecular sieve or a mixture of at least one large-pore molecular sieve catalyst and at least one medium-pore molecular sieve catalyst. Large-pore molecular sieves suitable for use herein can be any molecular sieve catalyst having an average pore diameter greater than 0.7 nm which are typically used to catalytically "crack" hydrocarbon feeds. It is preferred that both the large-pore molecular sieves and the medium-pore molecular sieves used herein be selected from those molecular sieves having a crystalline tetrahedral framework oxide component. Preferably, the crystalline tetrahedral framework oxide component is selected from the group consisting of zeolites, tectosilicates, tetrahedral aluminophosphates (ALPOs) and tetrahedral silicoaluminophosphates (SAPOs). More preferably, the crystalline framework oxide component of both the large-pore and medium-pore catalyst is a zeolite. It should be noted that when the cracking catalyst comprises a mixture of at least one large-pore molecular sieve catalyst and at least one medium-pore molecular sieve, the large-pore component is typically used to catalyze the breakdown of primary products from the catalytic cracking reaction into clean products such as naphtha for fuels and olefins for chemical feedstocks.

Large pore molecular sieves that are typically used in commercial FCC process units are also suitable for use herein. FCC units used commercially generally employ conventional cracking catalysts which include large-pore zeolites such as USY or REY. Additional large pore molecular sieves that can be employed in accordance with the present invention include both natural and synthetic large pore zeolites. Non-limiting examples of natural large-pore zeolites include gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, and ferrierite. Non-limiting examples of synthetic large pore zeolites are zeolites X, Y, A, L. ZK-4, ZK-5, B, E, F, H, J, M, Q, T, W, Z, alpha and beta, omega, REY and USY zeolites. It is preferred that the large pore molecular sieves used herein be selected from large pore zeolites. The more preferred large-pore zeolites for use herein are the faujasites, particularly zeolite Y, USY, and REY.

Medium-pore size molecular sieves that are suitable for use herein include both medium pore zeolites and silicoaluminophosphates (SAPOs). Medium pore zeolites suitable for use in the practice of the present invention are described in "Atlas of Zeolite Structure Types", eds. W. H. Meier and D. H. Olson, Butterworth-Heineman, Third Edition, 1992, which is hereby incorporated by reference. The medium-pore size zeolites generally have an average pore diameter less than about 0.7 nm, typically from about 0.5 to about 0.7 nm and includes for example, MFI, MFS, MEL, MTW, EUO, MTT, HEU, FER, and TON structure type zeolites (IUPAC Commission of Zeolite Nomenclature). Non-limiting examples of such medium-pore size zeolites, include ZSM-5, ZSM-12, ZSM-22, ZSM-23, ZSM-34, ZSM-35, ZSM-38, ZSM-48, ZSM-50, silicalite, and silicalite 2. The most preferred medium pore zeolite used in the present invention is ZSM-5, which is described in U.S. Pat. Nos. 3,702,886 and 3,770,614. ZSM-11 is described in U.S. Pat. No. 3,709,979; ZSM-12 in U.S. Pat. No. 3,832,449; ZSM-21 and ZSM-38 in U.S. Pat. No. 3,948,758; ZSM-23 in U.S. Pat. No. 4,076,842; and ZSM-35 in U.S. Pat. No. 4,016,245. As mentioned above SAPOs, such as SAPO-11, SAPO-34, SAPO-41, and SAPO-42, which are described in U.S. Pat. No. 4,440,871 can also be used herein. Non-limiting examples of other medium pore molecular sieves that can be used herein are chromosilicates; gallium silicates; iron silicates; aluminum phosphates (ALPO), such as ALPO-11 described in U.S. Pat. No. 4,310,440; titanium aluminosilicates (TASO), such as TASO-45 described in EP-A No. 229,295; boron silicates, described in U.S. Pat. No. 4,254,297; titanium aluminophosphates (TAPO), such as TAPO-11 described in U.S. Pat. No. 4,500,651; and iron aluminosilicates. All of the above patents are incorporated herein by reference.

The medium-pore size zeolites used herein can also include "crystalline admixtures" which are thought to be the result of faults occurring within the crystal or crystalline area during the synthesis of the zeolites. Examples of crystalline admixtures of ZSM-5 and ZSM-11 are disclosed in U.S. Pat. No. 4,229,424 which is incorporated herein by reference. The crystalline admixtures are themselves medium-pore size zeolites and are not to be confused with physical admixtures of zeolites in which distinct crystals of crystallites of different zeolites are physically present in the same catalyst composite or hydrothermal reaction mixtures.

The large-pore and medium-pore catalysts of the present invention will typically be present in an inorganic oxide matrix component that binds the catalyst components together so that the catalyst product is hard enough to survive inter-particle and reactor wall collisions. The inorganic oxide matrix can be made from an inorganic oxide sol or gel which is dried to "glue" the catalyst components together. Preferably, the inorganic oxide matrix will be comprised of oxides of silicon and aluminum. It is also preferred that separate alumina phases be incorporated into the inorganic oxide matrix. Species of aluminum oxyhydroxides-γ-alumina, boehmite, diaspore, and transitional aluminas such as α-alumina, β-alumina, γ-alumina, δ-alumina, ϵ-alumina, κ-alumina, and ρ-alumina can be employed. Preferably, the alumina species is an aluminum trihydroxide such as gibbsite, bayerite, nordstrandite, or doyelite. The matrix material may also contain phosphorous or aluminum phosphate. It is within the scope of this invention that the large-pore catalysts and medium-pore catalysts be present in the same or different catalyst particles, in the aforesaid inorganic oxide matrix.

As mentioned above, the contacting of the heavy hydrocarbonaceous feed with the cracking catalyst results in spent catalyst particles containing carbon deposited thereon and a lower boiling product stream. At least a portion, preferably substantially all, of the spent catalyst particles are conducted to a stripping zone. The stripping zone will typically contain a dense bed of catalyst particles where stripping of volatiles takes place by use of a stripping agent such as steam. There will also be space above the stripping zone wherein the catalyst density is substantially lower and which space can be referred to as a dilute phase. This dilute phase can be thought of as either a dilute phase of the reactor or stripper in that it will typically be at the bottom of the reactor leading to the stripper.

At least a portion, preferably substantially all, of the stripped catalyst particles are subsequently conducted to a regeneration zone wherein the spent catalyst particles are regenerated by burning coke from the spent catalyst particles in the presence of an oxygen containing gas, preferably air thus producing regenerated catalyst particles. This regeneration step restores catalyst activity and simultaneously heats the catalyst to a temperature from about 1202° F. (650° C.) to about 1382° F. (750° C.). At least a portion, preferably substantially all, of the hot regenerated catalyst particles are then recycled to the FCC reaction zone where they contact injected FCC feed.

The contacting of the heavy hydrocarbonaceous feed with the cracking catalyst also results in a lower boiling product stream. At least a portion, preferably substantially all of the lower boiling product stream is sent to a fractionation zone where various products are recovered, particularly at least a $C_3$ (propylene) fraction, and a $C_6$ rich fraction, optionally and preferably a $C_4$ fraction and a cracked naphtha fraction. In the practice of the present invention, at least a portion of the $C_6$ rich fraction is recycled to various points in the FCC unit to obtain increased amounts of propylene. For example, it can be recycled to a dilute phase in the reactor above the dense phase of the stripping zone. The at least a portion of the $C_6$ rich fraction can also be introduced into the reaction zone by injecting it upstream or downstream of the injection point of the main FCC feed, typically in the riser. The at least a portion of the $C_6$ rich fraction can also be introduced into a second riser of a dual riser FCC process unit or it can be injected with the feed stream into the reaction zone.

The following example is presented for illustrative purposes only and is not to be taken as limiting the present invention in any way.

EXAMPLE 1

Figure 2:
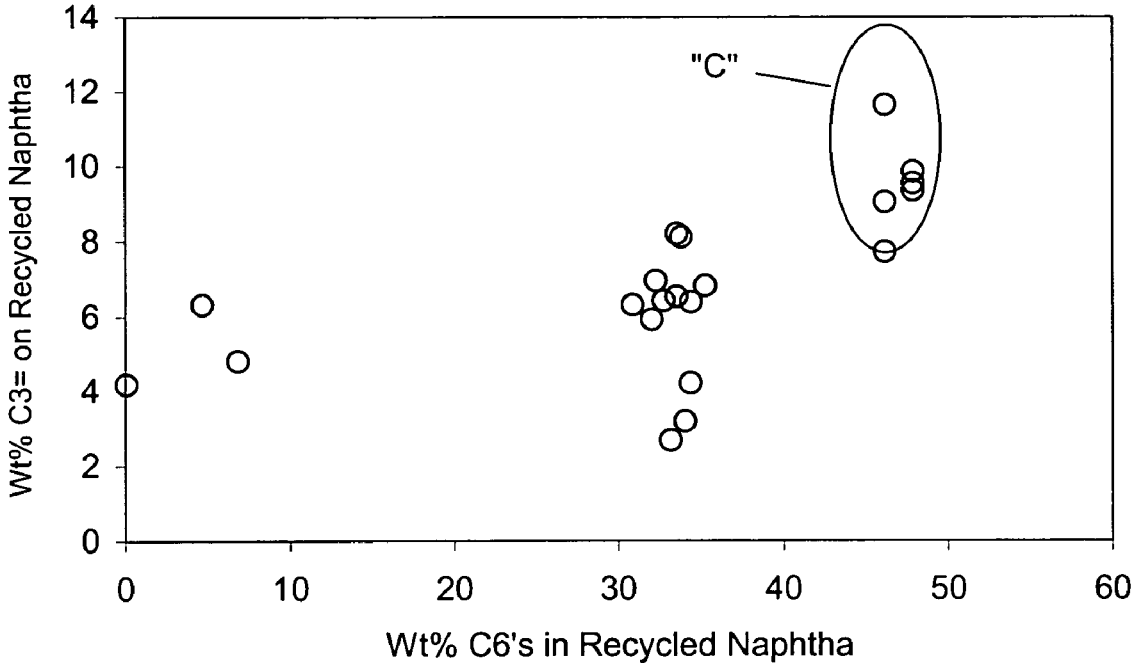
FIG. 2 shows the yield of propylene on recycled naphtha.

Tests were performed using three different streams in FCC process units to produce propylene. The three streams were Cat Naphtha A (light cat naphtha), Cat Naphtha B (heavy cat naphtha), and Cat Naphtha C ($C_6$-rich cat naphtha). The tests recycled a fraction of the FCC naphtha stream and injected it upstream of the primary feed injectors. Table 1 shows the test results of the three different streams. FIG. 1 shows the propylene selectivity from the data in Table 1. The average propylene selectivity was 0.62 for Cat Naphtha C, 0.37 for Cat Naphtha A, and 0.29 for Cat Naphtha B. FIG. 2 shows the yield of propylene on recycled naphtha from the data in Table 1. Propylene yields averaged 9.5 wt % on recycled naphtha for Cat Naphtha C, 6.0 wt % for Cat Naphtha A, and 5.1 wt % for Cat Naphtha B.

TABLE 1

| | Cat Naphtha | | | | | | | | | | |
|---|---|---|---|---|---|---|---|---|---|---|---|
| | A | A | A | A | B | A | A | B | B | A | A |
| Recycled Naphtha Feed Rate, wt. % FF | 5.6 | 8.5 | 5.2 | 5.4 | 5.3 | 5.0 | 3.5 | 6.0 | 6.0 | 4.8 | 4.8 |
| Recycled Naphtha Composition: | | | | | | | | | | | |
| Wt. % C5 and Lighter | 39 | 40 | 36 | 38 | 0 | 43 | 44 | 2 | 1 | 40 | 43 |
| Wt. % C6 | 34 | 35 | 34 | 34 | 0 | 32 | 31 | 7 | 5 | 33 | 33 |
| Wt. % C7 and Heavier | 27 | 25 | 30 | 28 | 100 | 25 | 26 | 92 | 94 | 28 | 24 |
| Recycled Naphtha Converted, wt. % | 19.3 | 17.5 | 9.2 | 22.1 | 16.7 | 21.3 | 14.3 | 19.7 | 16.9 | 20.9 | 5.8 |
| C3H6 Yield Increase w/ Recycle, wt. % FF | 0.36 | 0.58 | 0.22 | 0.44 | 0.22 | 0.35 | 0.22 | 0.29 | 0.38 | 0.31 | 0.13 |
| C3H6 Yield on Converted Naphtha, wt. % | 33.0 | 38.9 | 45.8 | 36.7 | 25.0 | 32.7 | 44.0 | 24.4 | 37.3 | 30.7 | 46.4 |
| C3H6 Yield on Recycled Naphtha, wt. % | 6.4 | 6.8 | 4.2 | 8.1 | 4.2 | 7.0 | 6.3 | 4.8 | 6.3 | 6.4 | 2.7 |

| | Cat Naphtha | | | | | | | | | |
|---|---|---|---|---|---|---|---|---|---|---|
| | A | A | A | A | C | C | C | C | C | C |
| Recycled Naphtha Feed Rate, wt. % FF | 2.5 | 5.0 | 5.2 | 5.6 | 2.3 | 2.3 | 2.3 | 5.6 | 5.6 | 5.6 |
| Recycled Naphtha Composition: | | | | | | | | | | |
| Wt. % C5 and Lighter | 41 | 40 | 42 | 41 | 33 | 33 | 33 | 31 | 31 | 31 |
| Wt. % C6 | 34 | 34 | 34 | 32 | 46 | 46 | 46 | 48 | 48 | 48 |
| Wt. % C7 and Heavier | 25 | 26 | 24 | 27 | 21 | 21 | 21 | 21 | 21 | 21 |
| Recycled Naphtha Converted, wt. % | 18.0 | 9.2 | 25.6 | 16.3 | 12.4 | 18.1 | 9.9 | 21.9 | 16.4 | 17.5 |
| C3H6 Yield Increase w/ Recycle, wt. % FF | 0.16 | 0.16 | 0.43 | 0.33 | 0.18 | 0.27 | 0.21 | 0.55 | 0.52 | 0.53 |
| C3H6 Yield on Converted Naphtha, wt. % | 36.4 | 34.8 | 32.1 | 36.3 | 62.1 | 64.3 | 91.3 | 45.1 | 57.1 | 54.6 |

TABLE 1-continued

| | | | | | | | | | | |
|---|---|---|---|---|---|---|---|---|---|---|
| C3H6 Yield on Recycled Naphtha, wt. % | 6.5 | 3.2 | 8.2 | 5.9 | 7.7 | 11.6 | 9.1 | 9.9 | 9.4 | 9.5 |

Cat Naphtha A - light cat naphtha
Cat Naphtha B - heavy cat naphtha
Cat Naphtha C ("C") - C6 rich cat naphtha

The invention claimed is:

1. A process for increasing the yield of propylene from heavy hydrocarbonaceous feeds selected from the group consisting of heavy hydrocarbon oils comprising materials boiling above 565° C., heavy and reduced petroleum crude oil, petroleum atmospheric distillation bottoms, petroleum vacuum distillation, pitch, asphalt, bitumen, other heavy hydrocarbon residues, tar sand oils, shale oil and liquid products derived from coal liquefaction processes, in a Fluid Catalytic Cracking (FCC) Unit comprising at least a reaction zone, a stripping zone, a regeneration zone, and a fractionation zone, which process comprises:

(a) contacting, in said reaction zone under fluidized catalytic cracking conditions, a heavy hydrocarbonaceous feed with a catalytic cracking catalyst comprising at least a mixture of at least one large-pore molecular sieve and at least one medium-pore molecular sieve, wherein the average pore diameter of said large-pore molecular sieve is greater than about 0.7 nm, and the average pore diameter of said medium pore molecular sieve is less than about 0.7 nm, thereby resulting in spent catalyst particles containing carbon deposited thereon and a lower boiling product stream;

(b) contacting at least a portion of said spent catalyst particles with a stripping gas in the stripping zone under conditions effective at removing at least a portion of any volatiles therefrom thereby resulting in at least stripped spent catalyst particles;

(c) regenerating at least a portion of said stripped spent catalysts in a regeneration zone in the presence of an oxygen-containing gas under conditions effective at burning off at least a portion of said carbon deposited thereon thereby producing at least regenerated catalyst particles;

(d) recycling at least a portion of said regenerated catalyst particles to said reaction zone; (e) fractionating said product stream of step (a) to produce at least a fraction rich in propylene, a $C_6$ rich fraction containing at least about 50 wt. % of $C_6$ compounds and a naphtha boiling range fraction;

(f) collecting at least a portion of the fraction rich in propylene and naphtha fraction; and (g) recycling at least a portion of said $C_6$ rich fraction to a place in the Fluid Catalytic Cracking (FCC) Unit selected from the group consisting of: i) upstream of the injection of the heavy hydrocarbonaceous feed; ii) the stripping zone; iii) a dilute phase above the stripping zone; iv) within the heavy hydrocarbonaceous feed; v) a reaction zone, separate from that wherein the hydrocarbonaceous feed is reacted; and vi) downstream of the injection of the heavy hydrocarbonaceous feed.

2. The process of claim 1 wherein the large pore and medium pore molecular sieves are selected from those large pore and medium pore molecular sieves having a crystalline tetrahedral framework oxide component.

3. The process of claim 2 wherein the crystalline tetrahedral framework oxide component is selected from the group consisting of zeolites, tectosilicates, tetrahedral aluminophosphates (ALPOs) and tetrahedral silicoaluminophosphates (SAPOs).

4. The process of claim 2 wherein the crystalline framework oxide component of both the large-pore and medium-pore molecular sieve is a zeolite.

5. The process of claim 4 wherein said large-pore zeolite is selected from the group consisting of gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, and ferrierite; zeolites X, Y, A, L, ZK-4, ZK-5, B, E, F, H, J, M, Q, T, W, Z; alpha and beta, omega, REY and USY zeolites.

6. The process of claim 4 wherein medium-pore zeolite is selected from the group consisting of ZSM-5, ZSM-11, ZSM-12, ZSM-22, ZSM-23, ZSM-48, ZSM-50, and mixtures of medium pore zeolites.

7. The process of claim 1 wherein the medium-pore molecular sieve is a silicoaluminophosphate.

8. The process of claim 7 wherein the silicoaluminophosphate is selected from the group consisting of SAPO-11, SAPO-34, SAPO-41, and SAPO-42.

9. The process of claim 1 wherein the medium pore molecular sieve is selected from the group consisting of chromosilicates, gallium silicates, iron silicates, aluminum phosphates, titanium aluminosilicates, boron silicates, titanium aluminophosphates (TAPO), and iron aluminosilicates.

10. The process of claim 1 wherein the fluidized catalytic cracking conditions include temperatures from about 500° C. to about 650° C.

11. The process of claim 1 wherein the propylene rich fraction contains greater than about 60 wt % propylene.

12. The process of claim 1 wherein the at least a potion of the $C_6$ rich fraction is recycled upstream of where the heavy hydrocarbonaceous feed is injected.

13. The process of claim 1 wherein the at least a portion of the $C_6$ rich fraction is recycled to a dilute phase above the dense phase of the stripping zone.

14. The process of claim 1 wherein the $C_6$ rich fraction contains at least about 60 wt. % of $C_6$ compounds.

15. The process of claim 1 wherein the $C_6$rich fraction contains at least about 70 wt. % of $C_6$ compounds.

16. The process of claim 1 wherein said catalytic cracking catalyst further comprise an inorganic oxide matrix binder.

17. A process for increasing the yield of propylene from heavy hydrocarbonaceous feeds selected from the group consisting of heavy hydrocarbon oils comprising materials boiling above 565° C., heavy and reduced petroleum crude oil, petroleum atmospheric distillation bottoms, petroleum vacuum distillation, pitch, asphalt, bitumen, other heavy hydrocarbon residues, tar sand oils, shale oil and liquid products derived from coal liquefaction processes, in a Fluid Catalytic Cracking (FCC) Unit comprising at least a reaction zone, a stripping zone, a regeneration zone, and a fractionation zone, which process comprises:

(a) contacting, in said reaction zone under fluidized catalytic cracking conditions, said heavy hydrocarbonaceous feed with a catalytic cracking catalyst comprising at least a large-pore molecular sieve, wherein the average pore diameter of said large-pore molecular sieve is greater than about 0.7 nm, thereby resulting in spent catalyst particles containing carbon deposited thereon and a lower boiling product stream;

(b) contacting at least a portion of said spent catalyst particles with a stripping gas in the stripping zone under conditions effective at removing at least a portion of any volatiles therefrom thereby resulting in at least stripped spent catalyst particles;

(c) regenerating at least a portion of said stripped spent catalysts in a regeneration zone in the presence of an oxygen-containing gas under conditions effective at burning off at least a portion of said carbon deposited thereon thereby producing at least regenerated catalyst particles;

(d) recycling at least a portion of said regenerated catalyst particles to said reaction zone;

(e) fractionating said product stream of step (a) to produce at least a fraction rich in propylene, a $C_6$ rich fraction containing at least about 50 wt. % of $C_6$ compounds and a naphtha fraction;

(f) collecting at least a portion of the fraction rich in propylene and naphtha fraction; and (g) recycling at least a portion of said $C_6$ rich fraction to a place in the Fluid Catalytic Cracking (FCC) Unit selected from the group consisting of: i) upstream of the injection of the heavy hydrocarbonaceous feed; ii) the stripping zone; iii) a dilute phase above the stripping zone; iv) within the heavy hydrocarbonaceous feed; v) a reaction zone, separate from that wherein the hydrocarbonaceous feed is reacted; and vi) downstream of the injection of the heavy hydrocarbonaceous feed.

18. The process of claim 17 wherein the large pore molecular sieves are selected from those large pore molecular sieves having a crystalline tetrahedral framework oxide component.

19. The process of claim 18 wherein the crystalline framework oxide component of the large-pore catalyst is a zeolite.

20. The process of claim 19 wherein said large-pore zeolite is selected from the group consisting of gmelinite, chabazite, dachiardite, clinoptilolite, faujasite, heulandite, analcite, levynite, erionite, socialite, cancrinite, nepheline, lazurite, scolecite, natrolite, offretite, mesolite, mordenite, brewsterite, and ferrierite; zeolites X, Y, A, L, ZK-4, ZK-5, B, E, F, H, J, M, Q, T, W, Z; alpha and beta, omega, REY and USY zeolites.

21. The process of claim 17 wherein the fluidized catalytic cracking conditions include temperatures from about 500° C. to about 650° C.

22. The process of claim 17 wherein the propylene rich fraction contains greater than about 60 wt. % propylene.

23. The process of claim 17 wherein the at least a portion of the $C_6$ rich fraction is recycled upstream of where the heavy hydrocarbonaceous feed is injected.

24. The process of claim 17 wherein the at least a portion of the $C_6$ rich fraction is recycled to a dilute phase above the dense phase of the stripping zone.

25. The process of claim 17 wherein the $C_6$ rich fraction contains at least about 60 wt. % of $C_6$ compounds.

26. The process of claim 17 wherein the $C_6$ rich fraction contains at least about 70 wt. % of $C_6$ compounds.

27. The process of claim 17 wherein said catalytic cracking catalyst further comprises an inorganic oxide matrix binder.

* * * * *